United States Patent [19]

Wu

[11] Patent Number: 4,751,765

[45] Date of Patent: Jun. 21, 1988

[54] SPRING HINGE

[76] Inventor: Chien C. Wu, No.23, Guey Hua Lane, Lu Kang Chen, Chang Hwa, Taiwan

[21] Appl. No.: 938,604

[22] Filed: Dec. 5, 1986

[51] Int. Cl.[4] ..... E05F 1/08

[52] U.S. Cl. ..... 16/256; 16/263; 16/301; 16/380

[58] Field of Search ..... 16/263, 380, 256, 259, 16/254, 264, 299-301, 381, 285

[56] References Cited

U.S. PATENT DOCUMENTS

| | | | |
|---|---|---|---|
| 822,911 | 6/1906 | Bommer | 16/256 |
| 1,175,550 | 3/1916 | Murray | 16/380 |
| 1,979,894 | 11/1934 | Lyons | 16/263 |
| 3,013,297 | 12/1961 | Ferry | 16/263 |
| 3,152,356 | 10/1964 | Parsons | 16/380 |
| 4,345,848 | 8/1982 | Cheselka | 16/263 |
| 4,573,239 | 3/1986 | Valenti et al. | 16/380 |

*Primary Examiner*—Nicholas P. Godici
*Assistant Examiner*—Samuel M. Heinrich
*Attorney, Agent, or Firm*—Birch, Stewart, Kolasch & Birch

[57] ABSTRACT

A spring hinge is provided which includes a first member, a second member, a spring, a spring seat, a tensile adjustment seat, a tensile adjustment pin, a shaft, and two holding heads. The holding heads each include a hollow hat and a spring member fixed inside the hollow hat, the central portion of the spring member being inwardly concave and having a set of slots radially extending to form a set of claws and an opening whose diameter is slightly smaller than the diameter of the shaft. Thus, the shaft penetrating through the opening is pressed and secured by the claws so as to prevent any withdrawal of the shaft from the opening.

2 Claims, 3 Drawing Sheets

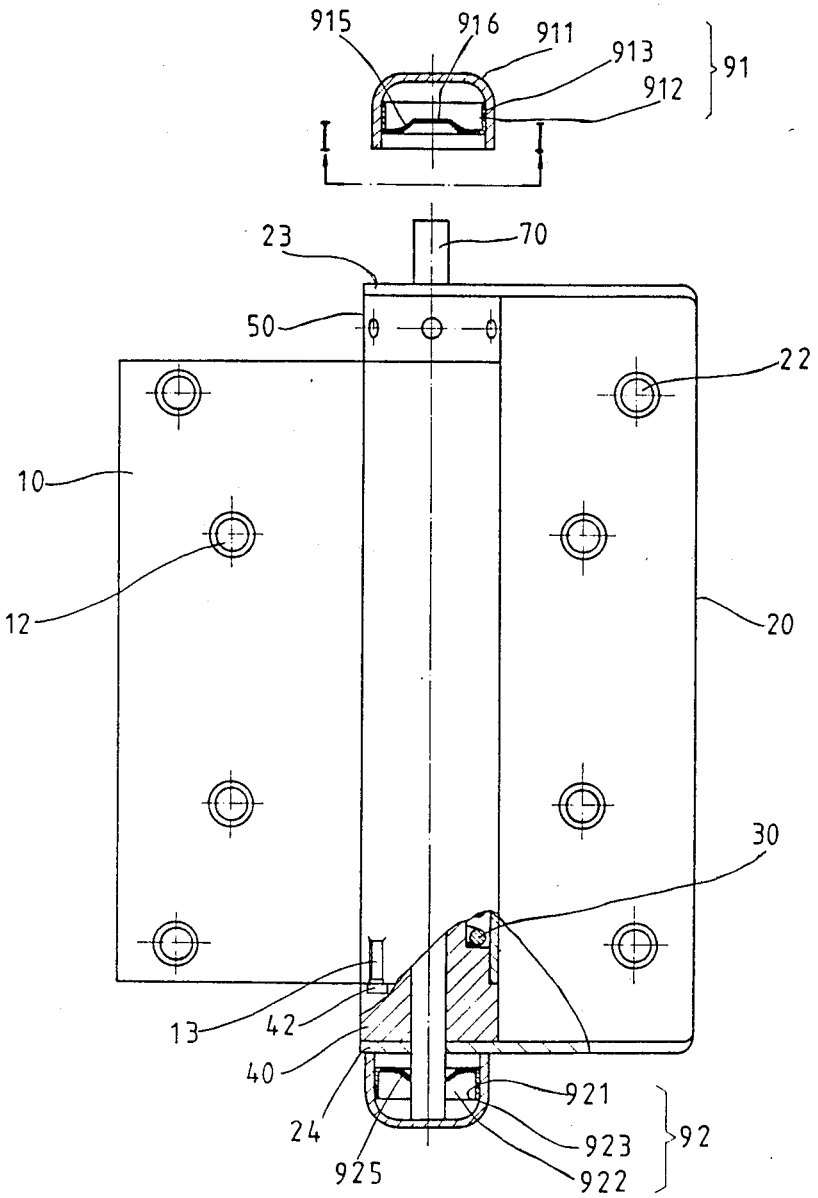
FIG. 3
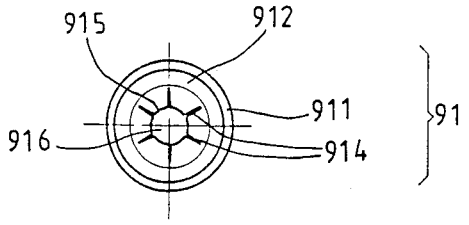
FIG. 4 (I-I)

SPRING HINGE

BACKGROUND OF THE INVENTION

1. Field of the Invention

The present invention is related to an improved spring hinge, and more particularly to the improved structure of a shaft and holding heads of such a spring hinge.

2. Description of Related Art

A mounted spring hinge can make an opened door close again automatically. As shown in FIG. 1, generally, the spring hinge includes a first member 10, a second member 20, a spring 30, a spring seat 40, a tensile adjustment seat 50, a tensile adjustment pin 60, shaft 70 and two holding heads 80, 81.

One side of the first member 10 is curved to form a tubular portion 11 while the other flat plate portion is provided with securing holes 12 for mounting the hinge on a door or door frame. The spring seat 40 has a central hole 41 providing for the penetration of shaft 70. On the edge of the hole 41 a gap 42 is provided for embedding one end 31 of spring 30 in position within the spring seat 40. Besides, this spring seat 40 is secured at the bottom of the tubular portion 11 of the first member by screwing or riveting. As shown in FIG. 3, the gap 42 of spring seat 40 is embedded and blocked against a concave part 13 provided at the bottom end of the tubular portion 11. The bottom end 31 of spring 30 can be connected to the first member 10 by means of the spring seat 40 indirectly.

The bottom of the tensile adjustment seat 50 can be inserted into the top end of the tubular portion 11 of the first member 10 and is provided with an aperture 52 for the insertion of the top end 32 of spring 30 therein. The second member 20 includes a plate portion 21 and two connecting pieces 23, 24 located at the top and bottom ends of one side respectively. Securing holes 22 are provided on the plate portion 21 for mounting the member 20 on doors or door frames, and each connecting piece 23, 24 includes a hole 25, 26 formed therein, respectively.

The two connecting pieces 23 and 24 are pressed into the spring seat 40 and tensile adjustment seat 50 respectively and hold the first member 10 and second member 20 together to form a hinge by means of the penetration of the shaft 70 between them. Besides, a pressing spring can be maintained between the first member 10 and second member 20 by inserting the tensile adjustment pin 60 into one of the suitable adjustment holes 53 located on the tensile adjustment seat 50.

It should be noted that the other side of the first member 10 can also be curved to form another tubular portion for connecting with a third member which is the same as the second member 20 in order to provide a double spring hinge.

The present invention particularly concerns the improvement of the shaft 70 and holding heads 80, 81. With reference to FIG. 1, it should be understood that the holding heads 80, 81 are screwed to the top and bottom ends of the shaft 70 respectively in order to prevent the dropping out of the shaft 70. Since the spring hinge includes a strong spring inside, if the holding head is loosened so that the shaft 70 drops out, the whole hinge will shoot out from the tubular portion because of the elastic force of the spring inside. This is dangerous because it may cause doors or windows to tilt over or fall off which may cause injury to people nearby.

The holding heads of known spring hinges, such as shown in FIG. 1, are made of metal or plastic with internal thread which can be engaged with the external thread of the shaft 70. But, this type of connection between the holding heads 80, 81 and shaft 70 has the disadvantage of being loose and falling off easily and frequently. Both providing a fixed hole and pin between the holding head and shaft, and riveting the holding head and penetrated shaft together are possible methods to overcome the drawbacks described above, but such methods may damage the outward appearance of the holding head and it is difficult to increase the production speed because of its complicated manufacturing process.

SUMMARY OF THE INVENTION

The primary object of the present invention is to provide a spring hinge which is easier to manufacture and is safer because the connection between its holding heads and shaft is simplified and firmly secured together.

In accordance with the present invention, a spring hinge includes a first member, a second member, a spring, a spring seat, a tensile adjustment seat, a tensile adjustment pin, a shaft and two holding heads, characterized in that the holding head includes a hollow hat, the central portion of the retaining member being inwardly concave and providing a set of radial slots extending to form a set of claws and an opening whose diameter is slightly smaller than the diameter of the shaft, and thus, the shaft penetrating through the opening is pressed and secured by the claws to prevent any withdrawal of the shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be more fully understood from the following detailed description, taken in connection with the accompanying drawings which form an integral part of this application and in which:

FIG. 3, is a cross sectional view of the spring hinge shown in FIG. 2; and FIG. 4, is a plane view of a holding head of the spring hinge shown in FIG. 2.

DETAILED DESCRIPTION OF THE PREFERRED EMBODIMENTS

Figure 1:
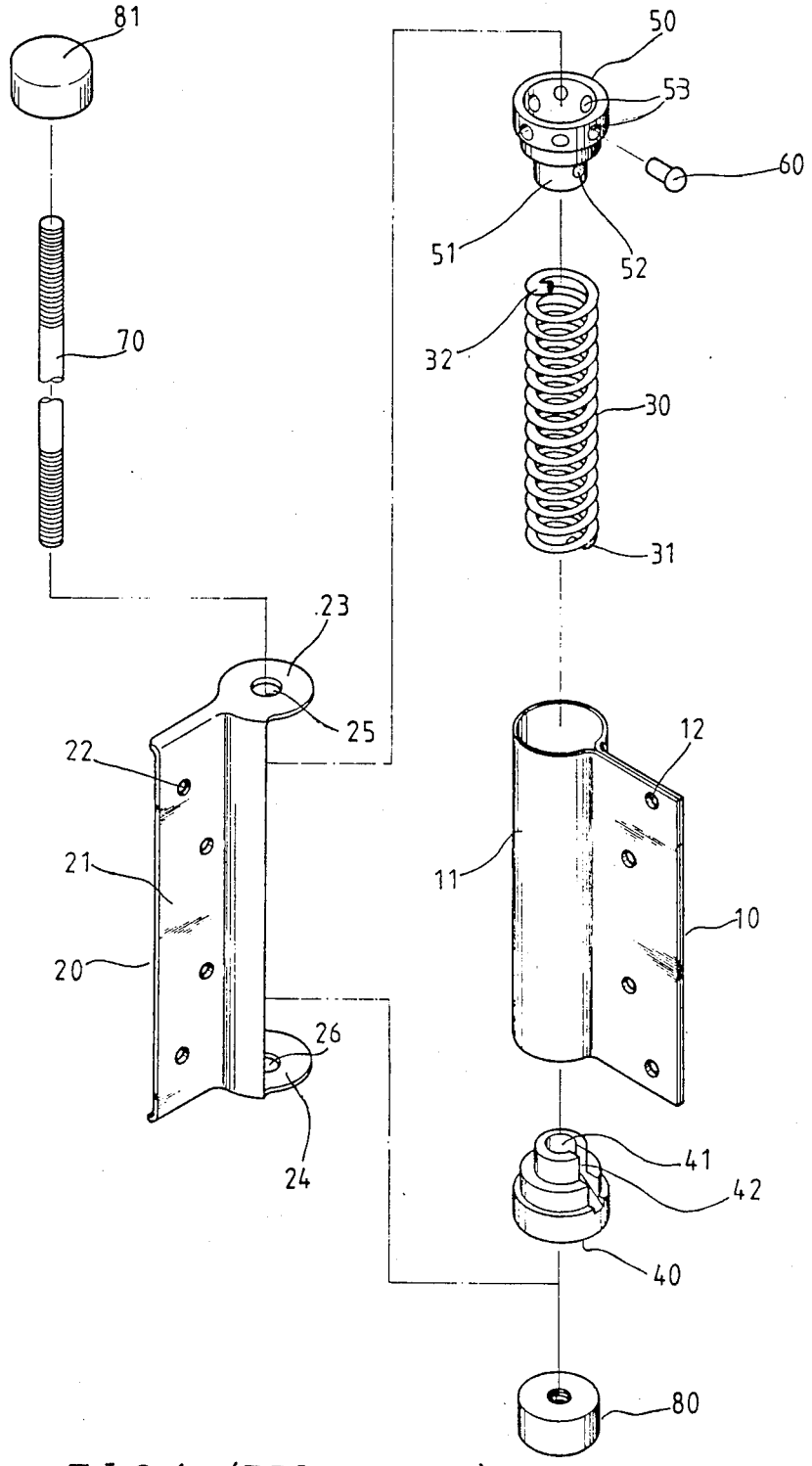
FIG. 1 (PRIOR ART)
FIG. 1 is an exploded view of a spring hinge according to the prior art.
Figure 2:
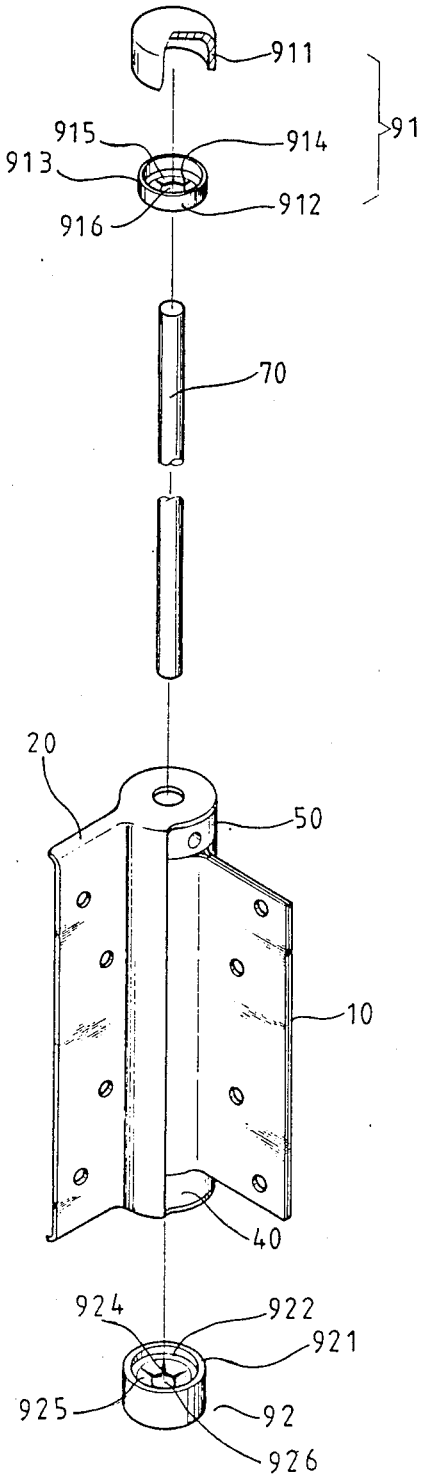
FIG. 2 is an exploded view of a spring hinge according to the preferred embodiment of this invention.

Referring now to the drawings, there is shown the spring hinge according to one preferred embodiment of the present invention. It should be noted that the first member 10, second member 20, spring 30, spring seat 40, tensile adjustment seat 50 and tensile adjustment pin 60 are similar to that of the known spring hinge shown in FIG. 1.

According to the present invention, the shaft 70 is not threaded for engagement with the holding heads 91 and 92 including a hollow hat 911, 921 and a retaining member 912, 922. The edge of the retaining member is provided with veins, so that it can be firmly inserted and fixed inside the hollow hat. Firstly, the retaining member is put inside the hollow hat, and then the veins 913 and 923 are pushed inwardly to fix it into position. Referring now to shaft retaining member 922, its central portion includes a set of slots 924 radially extending to form a set of claws 925 extending inwardly and an opening 926 located at the tip portion of each claw. The diameter of the opening 926 is slightly smaller than the diameter of shaft 70, for the insertion of the shaft 70. As shown in FIG. 3, it should be noted that since the diameter of opening 926 is smaller than the diameter of shaft 70, the shaft when penetrating through the opening 926 will be pressed and secured by the claws to prevent any withdrawal of the shaft from the opening.

When the inserted shaft 70 reaches the hollow hat 921, its flat end will press against the bottom of the hollow hat so that the shaft can be connected firmly and rigidly together with the entire holding head 92. Of course, the hollow hat and retaining member can be in the form of other shapes besides a circle, such as a hexagon or the like.

It should be understood that, according to the present invention, the shaft and holding head do not require any external or internal threads. During assembly, a pushing operation is performed instead of rotating the holding head. Accordingly, the manufacturing speed can be increased approximately three times and is greatly simplified. Moreover, the hinge provides for a safer operation and prevents the dropping out of the holding head.

While the invention has been described in connection with what is presently considered to be the most practical and preferred embodiment, it is to be understood that the invention is not to be limited to the disclosed embodiment but on the contrary, is intended to cover various modifications and equivalent arrangement included within the spirit and scope of the appended claims which scope is to be accorded the broadest interpretation so as to encompass all such modifications and equivalent structures.

What is claimed is:

1. A spring hinge comprising:

a first hinge member having a flat plate portion and a tubular housing portion;

a second hinge member having a flat plate portion and two connecting pieces positioned at opposing ends of one side of the flat plate portion, and two connecting pieces conforming to respective ends of the tubular housing;

a spring member positioned within the tubular housing;

spring seats formed within the two connecting pieces for receiving respective ends of the spring member;

a threadless shaft positioned within the axial length of the spring member;

two hollow holding heads fixable to respective ends of the threadless shaft; and a shaft retaining member positioned within each said hollow holding head and having radial flanges extending inwardly of and concave toward the end wall of the hollow holding head, wherein the radial flanges form an annular gripping region whose diameter is slightly smaller than the diameter of the threadless shaft;

wherein penetration of said threadless shaft through said annular gripping region will cause the shaft to abut against the end wall of each said hollow holding head and be gripped by said radial flanges so as to prevent withdrawal of the threadless shaft from the respective holding heads and thereby prevent erroneous removal of the threadless shaft from said tubular member.

2. The spring hinge according to claim 1, wherein said shaft retaining member includes raised veins periodically formed on the outer peripheral surface thereof to firmly and rigidly fix said shaft retaining member within said hollow holding head.

* * * * *